US006140623A

United States Patent [19]

Boehnlein et al.

[11] Patent Number: 6,140,623

[45] Date of Patent: Oct. 31, 2000

[54] DEFROST HEATER END CAP

[75] Inventors: Michael J. Boehnlein, Mishawaka; Michael J. Cousins, Granger, both of Ind.

[73] Assignee: Wirekraft Industries, Inc., Mishawaka, Ind.

[21] Appl. No.: 09/383,301

[22] Filed: Aug. 25, 1999

[51] Int. Cl.[7] ..... H05B 3/08

[52] U.S. Cl. ..... 219/541; 219/536; 62/276

[58] Field of Search ..... 219/201, 522, 219/526, 536, 541, 542, 546, 548, 553; 62/275, 276, 277

[56] References Cited

U.S. PATENT DOCUMENTS

| | | | |
|---|---|---|---|
| 2,758,150 | 8/1956 | Zargarpur . | |
| 3,280,581 | 10/1966 | Turner . | |
| 3,617,703 | 11/1971 | Ewart, Jr. | 219/541 |
| 3,895,500 | 7/1975 | Barton et al. | 62/275 |
| 4,091,637 | 5/1978 | Vogel et al. | 62/276 |
| 4,369,350 | 1/1983 | Kobayashi et al. | 62/276 |
| 4,492,851 | 1/1985 | Carr | 62/276 |
| 4,926,030 | 5/1990 | Knauss | 219/541 |
| 5,042,267 | 8/1991 | Beers et al. | 62/276 |
| 5,066,852 | 11/1991 | Willbanks | 219/541 |
| 5,545,878 | 8/1996 | Jasper, II et al. . | |
| 5,552,581 | 9/1996 | Jasper, II et al. . | |
| 5,968,397 | 10/1999 | Wyland et al. | 219/541 |

*Primary Examiner*—Teresa Walberg
*Assistant Examiner*—Fadi H. Dahbour
*Attorney, Agent, or Firm*—Herzog, Crebs & McGhee, LLP

[57] ABSTRACT

An end cap for a defrost heater is shown in which a positive locking mechanism is used to allow the lead wires to extend downward from the end cap. This increases the end cap's resistance to moisture and simplifies the design, thus lowering manufacturing cost. The end cap is also shown with a vertical vent that overlaps the retaining bore to significantly increase venting area over prior designs. The positive locking mating tab and the vent are located in two separate, but adjacent, vertical passages.

12 Claims, 3 Drawing Sheets

DEFROST HEATER END CAP

FIELD OF THE INVENTION

The present invention relates generally to end caps for defrost heaters, and more particularly to a low-cost, well vented end cap for use with quartz tube defrost heater systems.

BACKGROUND OF THE INVENTION

Since the 1960's it has been common for residential refrigerators to have a built-in defrost heater system. The defrost heater system prevents ice crystals from building up on the evaporator coils, which hampers the heat transfer capabilities of the coil, thereby overworking the compressor and eventually shortening the life of the unit.

The typical defrost heater system pioneered by General Electric includes one or more quartz tubes, each with a resistive heating element suspended therein and an end cap at either end. The end cap not only provides weld tab to keep the heating element suspended, but it also provides a means for attaching power leads to the heating element. Additionally, the end cap must keep as much moisture out of the tube as possible, as moisture can corrode and thus shorten the life of the heating element, or it can also corrode the contact in the end cap.

The end cap must also provide a vent for the defrost heater system. When the heating element is energized, the rise in temperature causes a sudden increase of the volume of the gas inside the quartz tube. The vent allows the gas to be released to the outside atmosphere. When the heating element is deenergized the opposite phenomenon occurs. As the temperature in the tube decreases, a partial vacuum forms in the tube. The vent allows outside air to enter the tube to relieve the vacuum. The rate at which air can flow in or out of the quartz tube is a function of smallest cross-sectional area of the vent. Prior art end caps typically have vents that terminate as a single hole in the throat of the end cap, where the quartz tube is received. Sometimes this is insufficient to provide the necessary venting depending upon environmental variables. If there is insufficient airflow the pressure differential between the air inside the quartz tube and the ambient air can cause the tube to break, and hence the heater system to fail.

As mentioned above, the end cap must keep moisture out of the quartz tube. For this reason, it has been known to place moisture seals or barriers around the point where the power leads enter the end cap. Such an end cap is shown in U.S. Pat. No. 3,280,581 to Turner, which is somewhat similar to the end caps that are still used today. Occasionally, these seals degrade and moisture which has condensed on the power supply wires will drip down the wire and into the end cap, thus providing additional modes of failure for the heater system.

Thus it is an object of the present invention to provide an end cap for a defrost heater system which provides increased airflow between the quartz tube and the ambient air.

It is a further object of the present invention to provide such an end cap with improved means of preventing moisture from entering the quartz tube.

It is also an object of the present invention to provide such an end cap at a reduced cost of manufacture compared to presently used end caps.

SUMMARY OF THE INVENTION

In keeping with the above, the present invention is an end cap for a defrost heater system having two vertical passages entering from the bottom of the cap. On one side of the end cap is a bore used to retain the quartz tube of the heater system.

According to one aspect of the present invention, the vertical passage closest to the retaining bore of the quartz tube overlaps the retaining bore to be in fluid communication therewith. Thus a vent is provided that extends the entire width of the vertical passage. In the preferred embodiment 15% of the area of the open end of quartz tube is open to the vent at the back of the retaining bore. This represents close to a 500% increase in the minimum cross-sectional area (bottle-neck) of the vent over currently used designs.

According to another aspect of the invention, the mating tab is oriented downward. As can be seen in the currently used end cap design, shown in FIGS. 1–3, the old mating tab extends out of the end cap through the top, and except for a small hook at the heating element end, is substantially flat. The present invention includes a mating tab designed to be incorporated with a positive locking mechanism. This mating tab is able to stay recessed in one of the vertical passages of the end cap (the one furthest from quartz tube). A wire harness is inserted into the vertical passages and locks with the mating tab.

The use of a positive locking mechanism allows the lead wires for the heater to exit from the bottom of the end cap, rather than the side or top. This, of course, keeps moisture out of the heater. It can also be pulled off (unlocked) with sufficient force. This alleviates the need for servicemen in the field to have to cut the lead wires to work on the heater system.

BRIEF DESCRIPTION OF THE DRAWINGS

So that the manner in which the above-identified features, advantages, and objects of the present invention are attained and can be understood in detail, a more particular description of the invention, briefly summarized above, may be had by reference to the embodiment thereof which is illustrated in the appended drawings.

It is noted, however, that the appended drawings illustrate only a typical embodiment of this invention and is therefore not to be considered limiting of its scope, for the invention may admit to other equally effective embodiments. Reference the appended drawings, wherein.

DETAILED DESCRIPTION OF THE INVENTION

Figure 1:
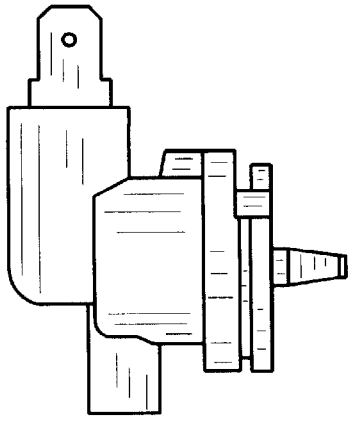
FIG. 1 PRIOR ART
FIG. 1. is a side view of a prior art end cap for a defrost heater system.
Figure 2:
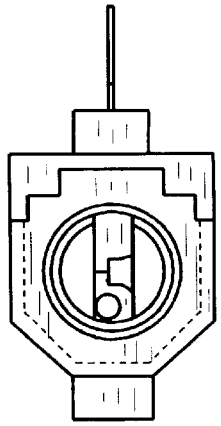
FIG. 2 PRIOR ART
FIG. 2 is an end view of the prior art end cap of FIG. 1.
Figure 3:
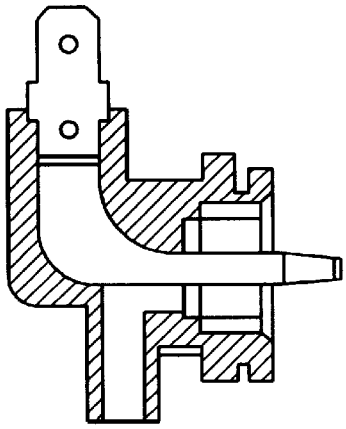
FIG. 3 PRIOR ART
FIG. 3 is a cross-sectional view of the prior art end cap of FIG. 1 taken along line 3—3.
Figure 4:
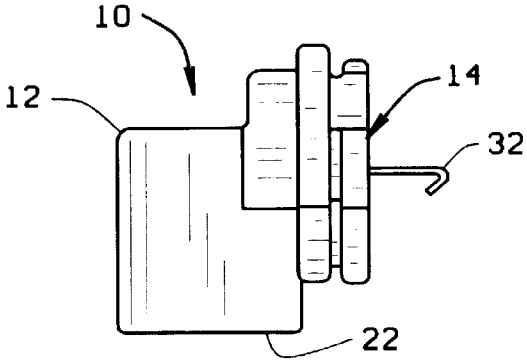
FIG. 4 is a side view of an end cap for a defrost heater system embodying the present invention.
Figure 5:
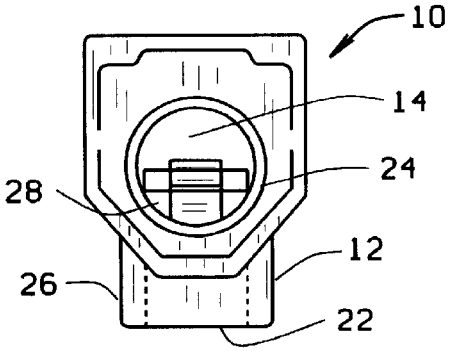
FIG. 5 is an end view of the end cap of FIG. 4.

Referring now to FIG. 4, an end cap 10 for a defrost heater system is shown generally, embodying the present invention.

The end cap 10 consists of a body 12, which in the preferred embodiment is made of a polymer such as Ryton®. On one side the body is formed to receive the quartz tube of the defrost heater in a retaining bore 14. It should be noted that defrost heaters at the present time use quartz tubes for various reasons, but should a better material be found, the present invention lends itself equally well to a heater tube made of another material.

In the bottom 22 of the body 12 are a proximal (to the retaining bore 14) recess 16 and a distal recess 18. In the preferred embodiment the recesses 16, 18 both have a typically rectangular cross section of equal size. The distal recess 18, which is adapted to receive a wire harness 20, may have a slightly irregular cross-section for that reason. The wire harness 20 will be discussed below.

The retaining bore has a seat 24 in it for a seal (not shown), as is found on conventional end caps. The seal provides additional protection against moisture intrusion. The remainder of the retaining bore 14 and the side 26 of the end cap 10 are very similar to conventional end caps known in the art, save the vent 28 found in the back wall of the retaining bore 14.

Figure 8:
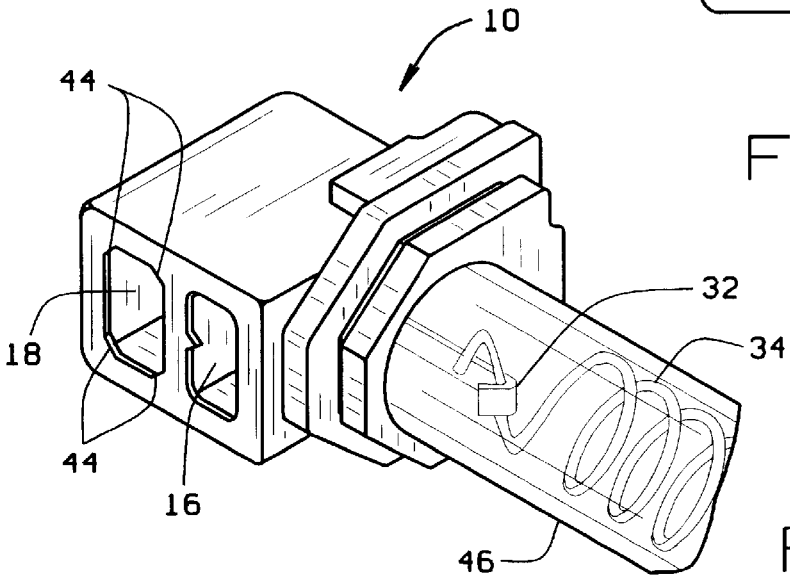
FIG. 8 is an isometric view showing the connection of the end cap of the present invention to the quartz tube and heating element.
Figure 9:
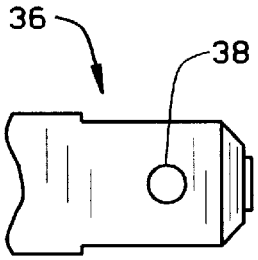
FIG. 9 is a detail of the mating tab of the end cap of the present invention.

Running from through the body of the end cap from the retaining bore to the distal recess is an electrical contact 30. One end of the contact preferably protrudes from the retaining bore 14 and ends in a weld tab 32. As can be seen in FIG. 8, the resistive heating element 34 is welded to the weld tab 32. At the opposite end of the contact 30 and located within the distal recess 18 is the mating tab 36.

Figure 10:
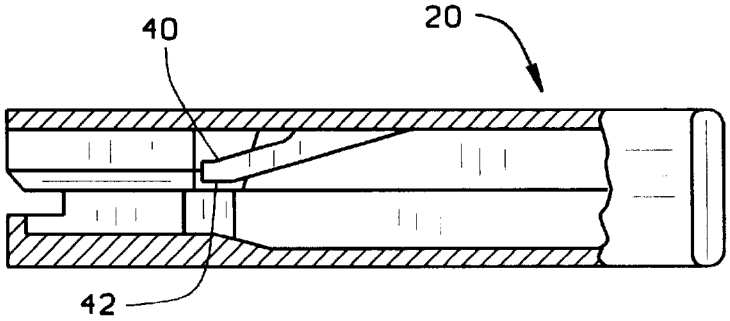
FIG. 10 is a cross-sectional view of wire harness designed for use with the end cap of the present invention.
Figure 11:
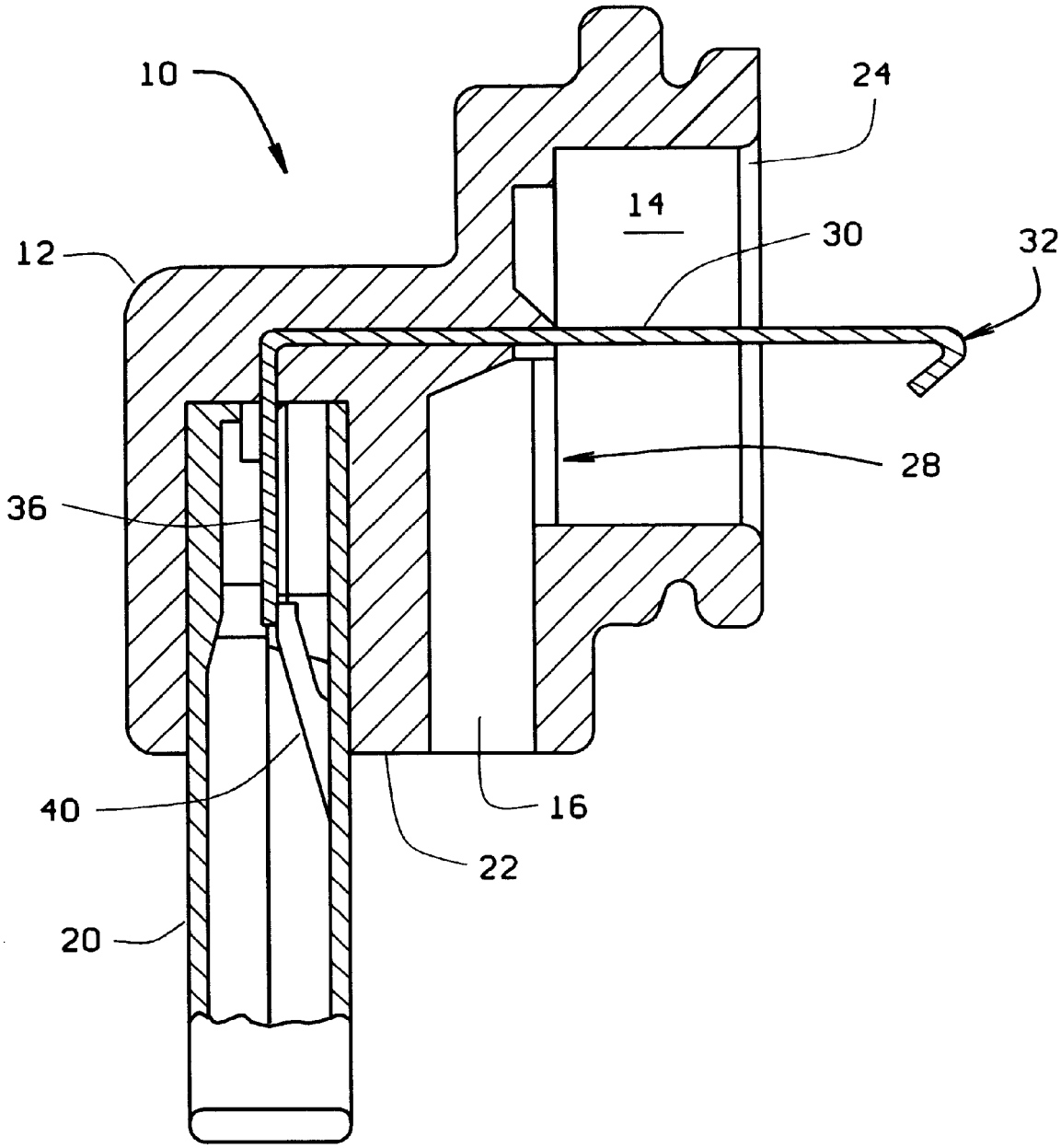
FIG. 11 is a cross-sectional view showing the connection of the mating tab of FIG. 9 to the wire harness of FIG. 10.

To make the present invention feasible, the mating tab 36 should use a positive locking mechanism. Such positive locking mechanisms can be custom designed by Amp, Inc. of Harrisburg, Pa. The mating tab in a positive locking system preferably has a small aperture 38. The wire harness 20 has a clip 40 with a small detent 42 as can be seen in FIG. 10. When the wire harness 20 is inserted into distal recess 18 the detent 42 is deflected slightly until it falls into place in the aperture 38 of the mating tab.

The wiring harness 20 is not limited in cross-sectional shape, however, the preferred embodiment includes a wiring harness 20 (and therefore a distal recess 18 to match) with a predominantly rectangular cross-sectional wiring harness. As can be seen in the embodiment shown, the rectangular cross-section may also included beveled corners 44.

The proximal recess 16 is used to vent the inside of the quartz tube 46 to the ambient air. When the heating element 34 is energized the sudden increase in temperature causes a rapid expansion of the gas inside the quartz tube 46. The vent 28 allows some of this gas to escape to the outside, thus relieving the pressure on the tube. When the heating element 34 is deenergized, the reverse process takes place. The cooling temperature inside the tube 46 causes a rapid contraction of the gas inside the tube 46. The vent 28 thus allows air from the outside to rush in to the tube 46 relieving the vacuum created therein. This process is known as breathing.

Figure 6:
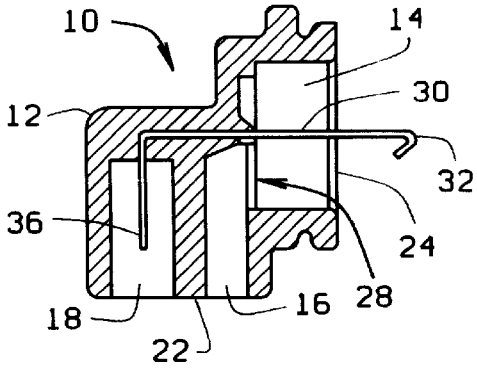
FIG. 6 is a cross-sectional view of the end cap of FIG. 4 taken along line 6—6.
Figure 7:
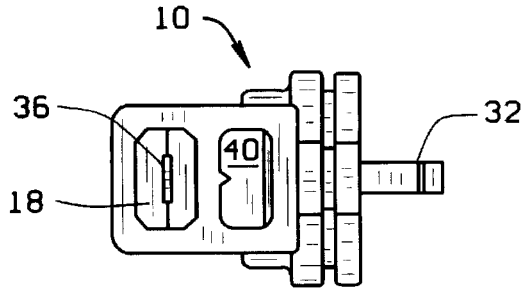
FIG. 7 is a bottom view of the end cap of FIG. 4.

The present invention provides a proximal recess 16 that abuts the back wall of the retaining bore 14. As is best seen in FIG. 6, the proximal recess 16 is thus placed in fluid communication with the retaining bore 14 (and necessarily the quartz tube 46) to allow the tube 46 to breath during operation.

This use of a vent 28 formed by a single proximal recess 16 abutting or overlapping the retaining bore 14, rather than the conventional method of using two separate round bores, allows an increase in venting cross-sectional area by a factor of five (5). The ability of the tube 46 to breath, measured by the amount of air that can enter or exit the tube at once, is directly proportional to the minimum cross-sectional area of the vent 28. Therefore, the present invention allows for significantly improved airflow over the prior art, thus reducing the chance of failure of the quartz tube 46 due to pressure differentials.

The venting area of the present invention is approximately 15% of the cross-sectional area of the quartz tube 46. In contrast, prior art designs, with two separate bores have a venting area less than 3% of the cross-sectional area of the quartz tube.

Another effect of placing the mating tab 36 in a distal recess 18 parallel to a proximal recess 16 for venting is a reduction in material used. The present design costs 40% less to produce than the conventional prior art design. It should also be noted that orienting the mating tab 36 downward alleviates the need for a moisture seal. This, together with the use of a positive locking mechanism, makes servicing the heater system in the field significantly easier for the repair personnel. In the past it has been necessary to cut the moisture seal around the lead wires close to their entry point into the end cap. A new connection would then need to be resoldered and the moisture seal replaced. With the present invention, the repair personnel have the ability to quickly and easily remove the wire harness 20, unlocking it from the mating tab 36. When the repair work is completed, the wire harness 20 can be just as quickly locked back in to place.

While the foregoing is directed to the preferred embodiments of the present invention, other and further embodiments of the invention may be devised without departing from the basic scope thereof, and the scope thereof is determined by the claims that follow.

We claim:

1. A defrost heater end cap comprising:

a body having a top, bottom, and a plurality of lateral sides;

a bore in one side of said body adapted to receive an end of a quartz tube;

an electrical connection recess in the bottom of said body;

an electrical conductor embedded within said body, having a weld tab extending from said bore at one end thereof and a terminal mating tab disposed within said electrical connection recess at the opposite end thereof; and a venting recess in the bottom of said body extending into said bore, said venting recess and said bore in fluid communication with each other and said venting recess and said electrical connection recess having a separation therebetween preventing direct fluid communication with each other.

2. The defrost heater end cap of claim 1, wherein said body consists of a polymer.

3. The defrost heater end cap of claim 2, wherein said body consists of polyphenylene sulfide resins.

4. The defrost heater end cap of claim 1, wherein said first recess is distal to said bore and said second recess is proximal to said bore.

5. The defrost heater end cap of claim 4, wherein said first recess is adapted to receive a wire harness.

6. The defrost heater end cap of claim 5, wherein said mating tab is adapted to couple with said wire harness using positive locking means.

7. The defrost heater end cap of claim 6, wherein said mating tab is generally flat and wherein said positive locking means include a bore extending through said mating tab to receive a detent disposed within the wire harness.

8. The defrost heater end cap of claim 1, wherein said second recess directly overlaps with said bore.

9. The defrost heater end cap of claim 1, further comprising an extension integrally formed with said body and protruding from the side of said body containing said bore, and wherein said bore is located within said extension.

10. The defrost heater end cap of claim 9, wherein said extension has a width greater than the width of the remaining portion of said body.

11. A defrost heater end cap comprising:

a body having a top, bottom, and a plurality of lateral sides, the bottom having at least first and second portions that are not flush with each other;

a bore in one side of said body adapted to receive an end of a quartz tube;

an electrical connection recess in the bottom of said body extending into said body from the first portion of the bottom thereof;

an electrical conductor embedded within said body, having a weld tab extending from said bore at one end thereof and a terminal mating tab disposed within said electrical connection recess at the opposite end thereof;

a venting recess in the bottom of said body extending into said body from the second portion of the bottom thereof and continuing into said bore, said venting recess and said bore in fluid communication with each other; and a separation between said electrical connection recess and said venting recess preventing direct fluid communication between said recesses.

12. The defrost heater end cap of claim 11, wherein said second recess directly overlaps with said bore.

* * * * *